US009874379B2

(12) United States Patent
Andres

(10) Patent No.: US 9,874,379 B2
(45) Date of Patent: Jan. 23, 2018

(54) EXPENDABLE DRIVEN HEAT PUMP CYCLES

(71) Applicant: HAMILTON SUNDSTRAND CORPORATION, Charlotte, NC (US)

(72) Inventor: Michael J. Andres, Roscoe, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 392 days.

(21) Appl. No.: 14/327,327

(22) Filed: Jul. 9, 2014

(65) Prior Publication Data

US 2016/0010902 A1 Jan. 14, 2016

(51) Int. Cl.

| | |
|---|---|
| ***F25B 27/00*** | (2006.01) |
| ***F25B 1/00*** | (2006.01) |
| ***F25B 31/02*** | (2006.01) |
| ***F25B 30/02*** | (2006.01) |
| ***F25B 6/04*** | (2006.01) |
| ***F25B 11/00*** | (2006.01) |
| ***F25B 9/00*** | (2006.01) |

(52) U.S. Cl.

CPC ..... *F25B 31/02* (2013.01); *F25B 6/04* (2013.01); *F25B 9/004* (2013.01); *F25B 11/00* (2013.01); *F25B 27/00* (2013.01); *F25B 30/02* (2013.01); *F25B 2339/041* (2013.01); *F25B 2341/0661* (2013.01); *F25B 2400/075* (2013.01); *F25B 2400/14* (2013.01)

(58) Field of Classification Search

CPC .. F25B 6/04; F25B 11/00; F25B 11/02; F25B 31/02; F25B 9/06; F25B 27/00; F25B 30/02; B64D 2013/0648

USPC ..... 62/236, 87, 116, 501, 506

See application file for complete search history.

(56) References Cited

U.S. PATENT DOCUMENTS

| | | | | |
|---|---|---|---|---|
| 7,987,683 | B2 | 8/2011 | Andres | |
| 2007/0193301 | A1* | 8/2007 | Andres | B64D 13/06 62/498 |
| 2007/0271938 | A1* | 11/2007 | Shaffer | F25B 27/00 62/228.1 |
| 2011/0219786 | A1* | 9/2011 | Andres | B64D 13/06 62/7 |
| 2012/0210728 | A1* | 8/2012 | Wang | F01D 15/10 60/788 |

FOREIGN PATENT DOCUMENTS

| | | |
|---|---|---|
| DE | 3688631 | 11/1993 |
| DE | 60204743 | 12/2005 |
| EP | 0919706 | 6/1999 |

OTHER PUBLICATIONS

Extended European Search Report dated Mar. 10, 2016 in European Application No. 15175841.4.

* cited by examiner

*Primary Examiner* — Joseph Trpisovsky
(74) *Attorney, Agent, or Firm* — Snell & Wilmer L.L.P.

(57) ABSTRACT

A cooling system with a compression cooling cycle for a working fluid that passes an expendable fluid through a warm side heat exchanger for the cooling system to cause the expendable fluid to vaporize and thus absorb heat from the working fluid by way of latent heat or enthalpy of vaporization and then running the vaporized expendable through a turbine that drives a compressor for the cooling system.

10 Claims, 5 Drawing Sheets

EXPENDABLE DRIVEN HEAT PUMP CYCLES

FIELD

The present disclosure relates to compression cycle cooling systems, and more particularly to both vapor and air cycle cooling systems that utilize an expendable fluid to assist the cooling system cycle.

BACKGROUND

Some proposed high energy applications, such as high energy lasers and high speed long-range aircraft, have large cooling requirements with limited available electric or mechanical shaft power and limited available heat sinking for conventional vapor and air compression cycle cooling systems. High-energy laser systems have relatively low efficiencies that cause waste heat to be approximately three or more times their beam energy. At the same time, they only operate effectively within stringent temperature ranges. High-speed long-range aircraft produce large engine and airframe heat loads during the major portions of their flights that typically consume the available fuel heat sink capacity. Additionally, the high speed at which such aircraft operate makes ram air heat sinks less suitable due to the high temperatures and drag produced at high speeds.

Some cooling systems have used the latent heat or enthalpy of vaporization for an expendable boiling liquid to assist heat extraction. However, such systems have only been suitable for short-term heat loads, such as during supersonic dash flights.

SUMMARY

According to various embodiments, a cooling system comprising a compression cycle for cooling a working fluid is disclosed. The cooling system may comprise a cool side heat exchanger for transferring thermal energy from a heat load to the working fluid that heats the working fluid. The cooling system may comprise a compressor driven by a motor that receives the heated working fluid and compresses it to a high-pressure. The cooling system may comprise a warm side heat exchanger that receives the heated high-pressure working fluid from the compressor and cools it with an expendable fluid (liquid or gas) that receives heat from the heated high-pressure working fluid and vaporizes it to produce a pressurized expendable fluid. The cooling system may comprise a turbine powered by the pressurized expendable fluid that assists the motor to drive the compressor. The cooling system may comprise a backpressure control valve configured to be coupled in series between the turbine and the warm side heat exchanger. The cooling system may comprise an expendable fluid storage tank for storing the expendable fluid. The cooling system may comprise an expendable feed pump for transferring expendable fluid from the expendable storage tank to the warm side heat exchanger.

According to various embodiments, a cooling system that uses a compression cycle for cooling a working fluid that comprises air is disclosed. The cooling system may comprise a cool side heat exchanger for transferring thermal energy from a heat load to lo pressure air that heats the low-pressure air. The cooling system may comprise a compressor driven by a motor that receives the heated low-pressure air and compresses it to a high-pressure. The cooling system may comprise a warm side heat exchanger that receives the heated high-pressure air from the compressor and cools it with an expendable liquid that receives heat from the heated high-pressure air and vaporizes it to produce a pressurized expendable fluid. The cooling system may comprise an air turbine that receives the cooled high-pressure air from the warm side heat exchanger, expands it to lower its pressure and temperature still further and assists the motor to drive the compressor. The cooling system may comprise a turbine powered by the pressurized expendable fluid that assists the motor to drive the compressor. The cooling system may comprise a backpressure control valve configured to be coupled in series between the turbine and the warm side heat exchanger.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the disclosure, it should be understood that other embodiments may be realized and that logical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented.

Furthermore, any reference to singular includes plural embodiments, and any reference to more than one component or step may include a singular embodiment or step.

Vapor cycle systems are commonly used as heat pumps for stationary and mobile applications. They can be powered by electric motors as in home air conditioners or by shaft power as in motor vehicles. Ambient air, either directly or indirectly via a water loop, is the most common heat sink for the condenser although water is used for some stationary heat pump applications.

Figure 1:
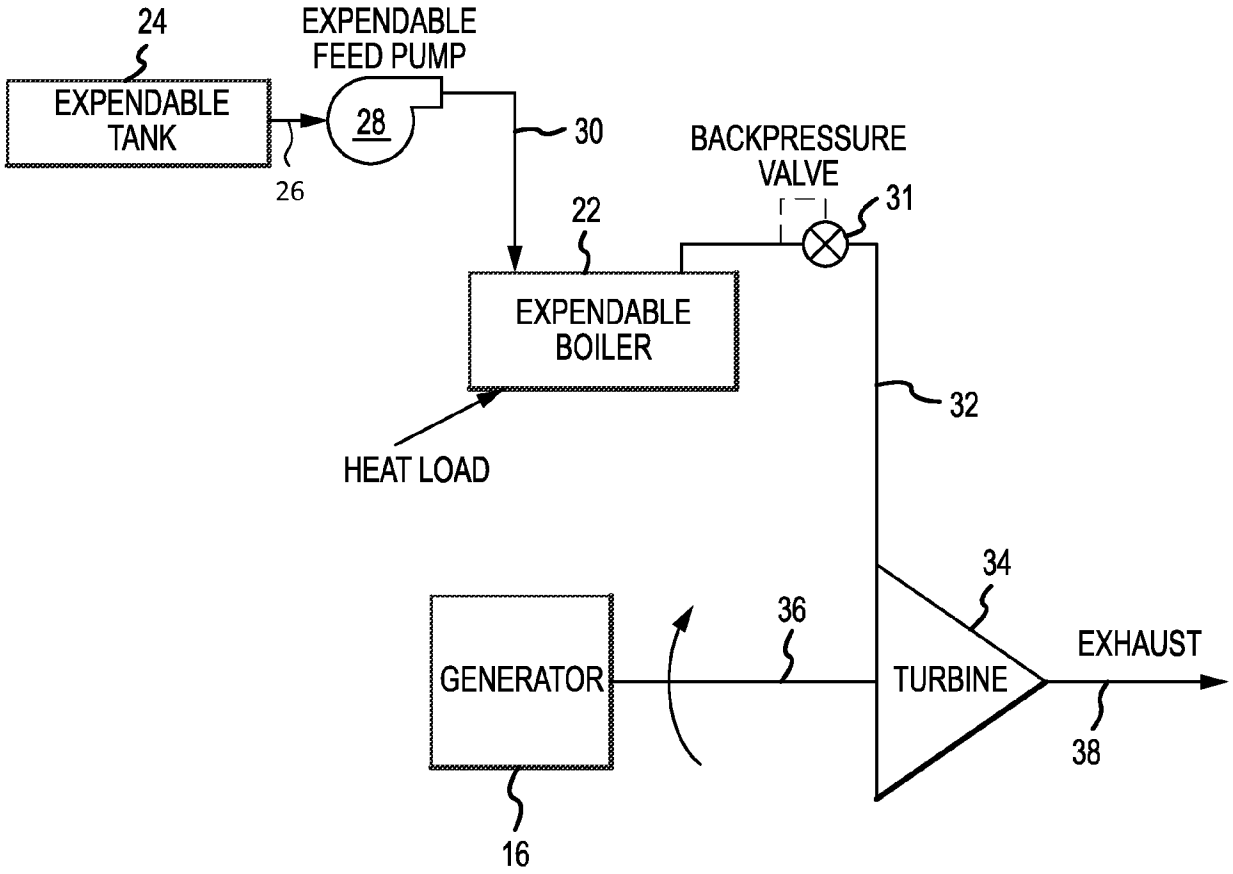
FIG. 1 is a schematic of an expendable turbine driven generator or other load that can cool a heat load directly.

In accordance with various embodiments, FIG. 1 may be compared to a simple

Rankine cycle that uses an appropriate expendable working fluid to absorb heat from the heat load either directly or indirectly via a heat transfer loop. A Rankine cycle is a model that is used to predict the performance of steam engines. The Rankine cycle is an idealized thermodynamic cycle of a heat engine that converts heat into mechanical work.

Air cycle systems are commonly used for aircraft applications since their temperature controlled output air can be used for cabin pressurization and bleed air is a readily available power source from turbine engines. Emerging systems for both ground and airborne vehicles commonly have large intermittent heat loads that must be rejected. While a conventional vapor or air cycle system described above can be used, it produces a large weight and volume penalty to the vehicle that continuously penalizes vehicle capability even if the cooling is just needed for short periods.

Expendable fluids may be stored either directly in the air cooled heat exchanger/ boiler 22 or in a separate storage tank and/or expendable fluid tank 24 for shorter start-up time and more consistent boiler 22 temperature. The terms "air cooled heat exchanger", "boiler" and "warm side heat exchanger" may be used interchangeably herein. The expendable fluid (or, more simply, the "expendable") may be any fluid that is storable in liquid state that has a suitable latent heat or enthalpy of vaporization and a boiling point within a reasonable pressure range for the purpose. Typical expendables that may be suitable for normal applications are propane and butane. Other expendables may be suitable for operating the heat exchanger 22 at temperature extremes, such as heavier hydrocarbons at elevated temperatures or even hydrogen at very low temperatures.

In response to a separate tank 24 being used, a feed pump 28 may be used to transfer the expendable from the storage tank 24 to the boiler. The expendable tank 24 discharges expendable into an expendable tank output path 26. An expendable feed pump 28 receives the expendable from the expendable tank output path 26 and discharges it into an expendable feed pump output path 30. In response to a feed pump 28 being used, the storage tank 24 pressure may be configured to be lower than boiler 22 pressure. Boiler 22 pressure may be regulated by the backpressure valve 31 to set the desired temperature of the fluid in the boiler 22. Ideally, the backpressure valve 31 is set to an open position at the design point with the turbine 34 nozzle area determining boiler 22 pressure. This tends to minimizes throttling losses in the system.

The expendable absorbs heat from a heat load to be cooled in the heat exchanger 22. The heat load transfers heat to the expendable within the heat exchanger 22, thereby changing its state from a liquid to a pressurized gas. The heat exchanger 22 therefore serves as a boiler for the expendable. The latent heat or enthalpy of vaporization for the expendable allows the heat exchanger 22 to provide a significant heat transfer with minimal size and weight. The heat exchanger 22 then discharges the pressurized expendable vapor into an expendable turbine vapor output path 32.

Considerations in setting the desired regulated boiler 22 pressure include the vapor pressure vs. temperature characteristics of the fluid, turbine 34 inlet pressure and temperature for power production and safety considerations. The turbine drive shaft 36 power produced by the turbine 34 can be used to drive a generator 16 (e.g., a motor configured to be back driven) as shown or any other shaft driven device. The fluid exiting the turbine 34 is exhausted to ambient.

A turbine 34 receives the pressurized expendable vapor from the expendable turbine vapor output path 32 and drives the generator 16, through a turbine drive shaft 36. The turbine 34 expands the pressurized expendable vapor, thereby increasing its velocity and lowering its pressure, and discharges the high velocity low-pressure expendable vapor into a turbine output path 38.

Figure 2:
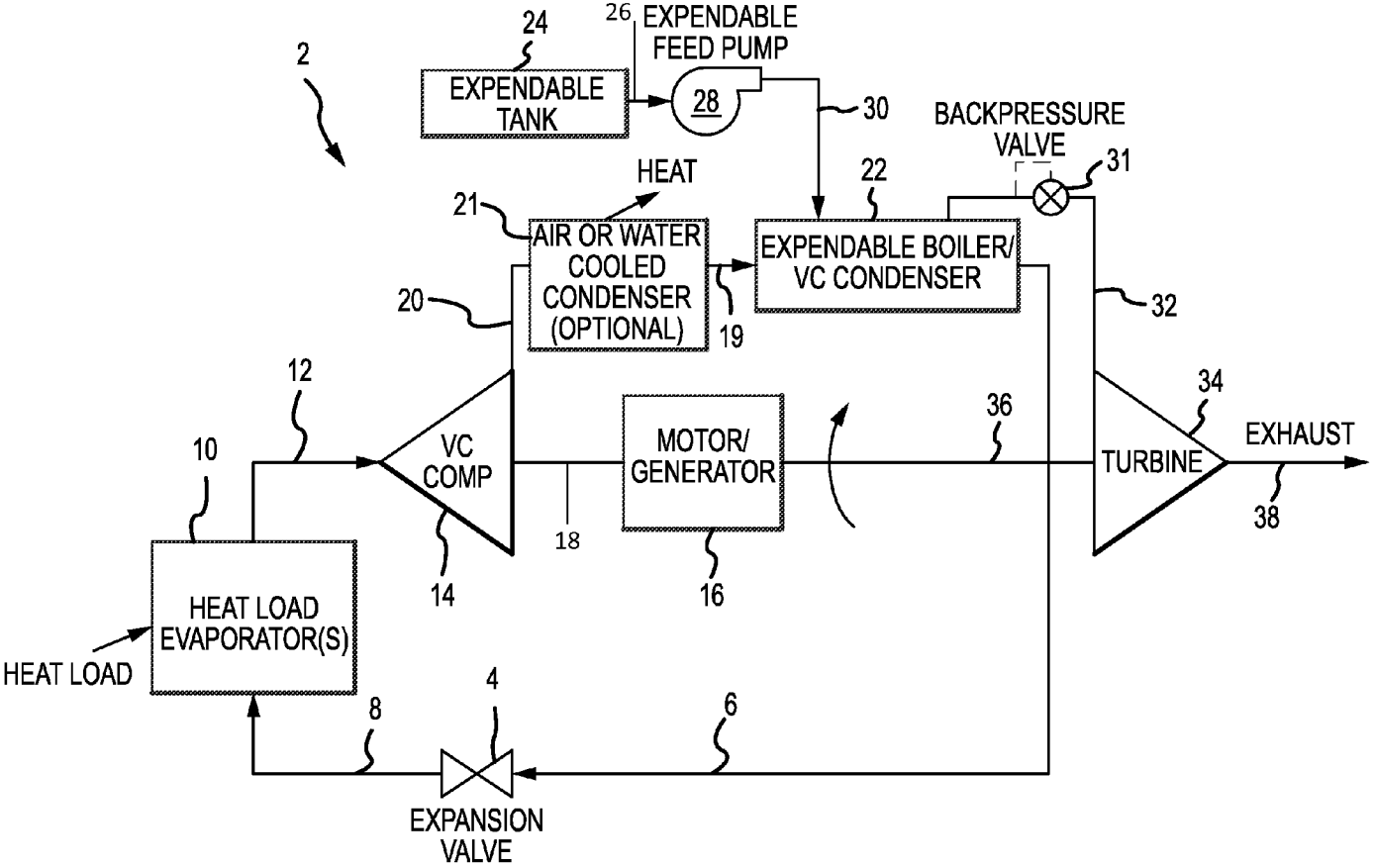
FIG. 2 is a schematic of an expendable turbine driven vapor compression cycle cooling system in accordance with various embodiments.

FIG. 2 is a schematic of an expendable turbine driven vapor compression cycle cooling system 2 in accordance with various embodiments. An expansion valve 4 receives high-pressure working fluid in a liquid state from a high-pressure working fluid supply path 6. The working fluid may comprise any desirable working fluid that has a suitable latent heat or enthalpy of vaporization and boiling point within a reasonable pressure range for a target application. The expansion valve 4 restricts flow of the liquid working fluid from the high-pressure working fluid supply path 6 into an expansion valve output path 8, thereby reducing pressure of the working fluid in the expansion valve output path 8.

A low temperature or cool side heat exchanger 10 receives the low-pressure working fluid from the expansion valve output path 8. It also transfers heat $Q_T$ from a heat load to the low-pressure working fluid and serves as an evaporator that causes the working fluid to rise in temperature to its boiling point and absorb even more heat from the heat load due to its enthalpy of vaporization as it changes state to a vapor.

The low temperature or cool side heat exchanger 10 then discharges the low-pressure heated working fluid in its vapor state into low temperature heat exchanger output path 12.

A compressor 14, driven by a motor/generator 16 through a compressor drive shaft 18, receives the low-pressure heated working fluid from the low temperature heat exchanger output path 12, compresses it to a high-pressure and discharges the high-pressure heated working fluid into a compressor output path 20. The motor/generator 16 may be any suitable machine, such as a dynamoelectric machine of the electric motor or motor/generator type, a hydraulic motor, an output shaft from a vehicle propulsion engine or a turbine driven by an available fluid, such as bleed air from the compressor of a gas turbine engine.

The added vapor cycle system shown is a simple system although more complex systems using intermediate pressure flash tanks and/or multiple evaporators in parallel or at different pressures can be used. Cooling system 2 as shown includes a motor/generator 16 on the same shaft as turbine 34 and compressor 14 to balance the power during some or all operating conditions. Similarly, a supplemental condenser 21 is shown that can be water or air cooled to balance the thermal energy. Supplemental condenser 21 may be coupled to compressor 14 via compressor output path 20. Supplemental condenser 21 may be coupled to the heat exchanger 22 via condenser output path 19.

A warm side heat exchanger 22 according to the disclosure receives the high-pressure heated working fluid from the compressor output path 20 and cools it with a liquid expendable fluid. As in FIG. 1, the heat exchanger 22 itself may store a quantity of expendable, or the expendable may have external storage. FIG. 2 shows an expendable tank 24 for storing expendable. The expendable tank 24 discharges expendable into an expendable tank output path 26. An expendable feed pump 28 receives the expendable from the expendable tank output path 26 and discharges it into an expendable feed pump output path 30. The feed pump 28 may couple to the motor/generator 16 or it may have its own separate source of motive power. The heat exchanger 22 then receives the expendable from the expendable feed pump output path 30. The output of the exchanger 22 may be regulated by backpressure valve 31 located between exchanger 22 and turbine 34 generally located in series along expendable turbine vapor output path 32.

As noted above, the expendable is stored either directly in the boiler 22 or in a separate storage tank 24 for shorter start-up time and more consistent boiler 22 temperature. In response to a separate tank 24 being used, a feed pump 28 may be used to transfer the fluid from the storage tank 24 to the boiler. In response to a feed pump 28 being used, the storage tank 24 pressure may be configured to be lower than boiler 22 pressure.

The separate expendable tank 24 and pump 28 may be more suitable for applications that require a longer operation where a larger tank would not be required to withstand turbine inlet pressure and the pump 28 is not a large part of the overall system. The separate expendable tank 24 may also be more suitable for a low or zero g application where the expendable tank 24 is of an accumulator or bladder type and usable in combination with a zero g tolerant heat exchanger 22.

The expendable absorbs heat from the heated high-pressure working fluid in the heat exchanger 22, and the heat exchanger 22 serves as a condenser that cools the high-pressure working fluid to below its boiling point at the high-pressure and changes its state back into a high-pressure liquid. The condensing heat exchanger or condenser 22 then discharges the cooled high-pressure working fluid into the high-pressure working fluid supply path 6, thereby completing the cycle. At the same time, the high-pressure working fluid transfers heat to the expendable within the heat exchanger 22, thereby changing its state from a liquid to a pressurized gas. The heat exchanger 22 therefore serves as a boiler for the expendable. The latent heat or enthalpy of vaporization for the expendable allows the heat exchanger 22 to provide a significant heat transfer with minimal size and weight. The heat exchanger 22 then discharges the pressurized expendable vapor into an expendable turbine vapor output path 32.

Considerations in setting the desired regulated boiler 22 pressure include the vapor pressure vs. temperature characteristics of the fluid, and the turbine 34 inlet pressure and temperature for power production and safety considerations. The turbine drive shaft 36 power produced by the turbine 34 can be used to drive a generator 16 as shown or any other shaft driven device. The fluid exiting the turbine 34 is exhausted to ambient.

A turbine 34 receives the pressurized expendable vapor from the expendable turbine vapor output path 32 and drives the compressor 14, along with the motor/generator 16, through a turbine drive shaft 36. The turbine 34 expands the pressurized expendable vapor, thereby increasing its velocity and lowering its pressure, and discharges the high velocity low-pressure expendable vapor into a turbine output path 38.

Vaporizing the expendable in the heat exchanger 22 tends to maximize the degree of heat sinking that it can provide and driving the turbine 34 with the vaporized expendable assists driving the compressor 14 to minimize the electrical or mechanical shaft power required by the motor/generator 16. Thus, the cooling system 2 according to various embodiments provides greater cooling capacity with less input power than heretofore available systems.

Figure 3:
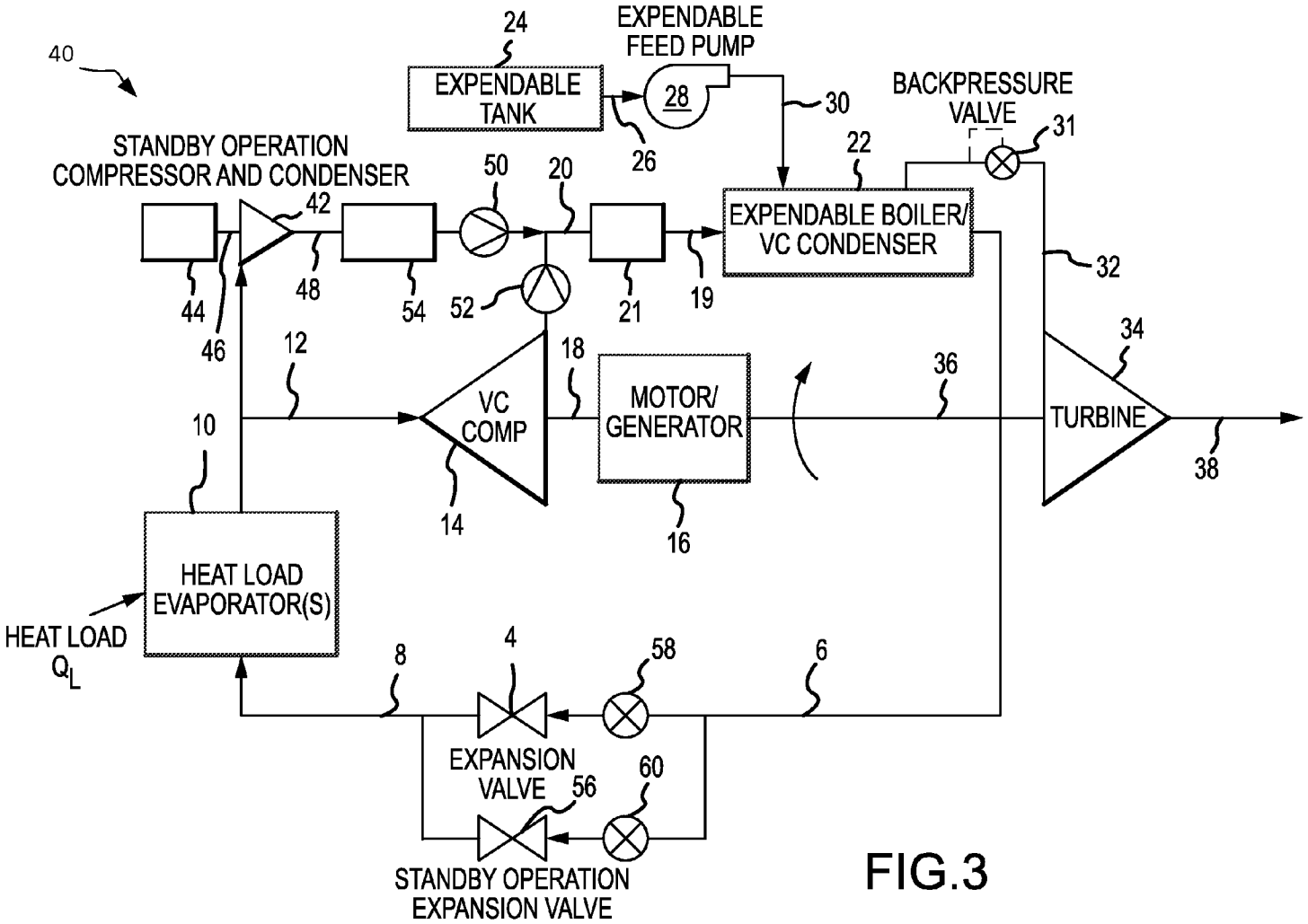
FIG. 3 is a schematic of an expendable turbine driven vapor compression cycle cooling system with a provision for standby operation in accordance with various embodiments.

Various applications may be configured to utilize a low power standby operation, such as the beam-off operation of the hereinbefore-described high-energy lasers. FIG. 3 is a schematic of an expendable turbine driven vapor compression cycle cooling system 40 with a provision for standby operation according to various embodiments. Cooling system 40 is similar in basic operation to the cooling system 2 as described in connection with FIG. 2. However, cooling system 40 further comprises a small flow capacity standby compressor 42, driven by a small standby motor/generator 44 through a standby compressor drive shaft 46 that also receives the low-pressure heated working fluid from the low temperature heat exchanger output path 12. During standby operation, the motor/generator 16 shuts down and the standby motor/generator 44 begins operation. The standby compressor 42 compresses a sufficient volume of low-pressure heated working fluid from the low temperature heat exchanger output path 12 for standby operation to a high-pressure and discharges the high-pressure heated working fluid into a standby compressor output path 48. The high-pressure heated working fluid in the compressor output path 48 feeds into the compressor output path 20.

According to various embodiments and with reference to FIG. 3, a vapor cycle system driven at least partially by the expendable driven turbine 34 is depicted. FIG. 3 illustrates a standby compressor flow control valve 50 in the standby compressor output path 48 to prevent flow of high-pressure heated working fluid from the compressor 14 back into the standby compressor 42 during normal operation and a compressor flow control valve 52 in the compressor output path 20 to prevent flow of high-pressure heated working fluid from the standby compressor 42 back into the compressor 14 during standby operation. The flow control valves 50 and 52 may be check valves as shown in FIG. 3 or other means for preventing backflow, such as sequentially operated shut-off valves.

If it is undesirable to consume expendable during standby operation, a small standby heat exchanger or condenser 54 in the standby compressor output path 48 upstream of the may provide suitable cooling for the high-pressure heated working fluid supplied by the standby compressor instead. In this case, ram air, fuel or other available heat sink may cool the standby heat exchanger or condenser 54.

A small flow capacity standby expansion valve 56 receives the cooled high-pressure working fluid from the high-pressure working fluid supply path 6 during standby operation and discharges high-velocity low-pressure working fluid into the expansion valve output path. The capacity of the standby expansion valve is suitable for the smaller volume of cooled high-pressure working fluid supplied by the high-pressure working fluid supply path 6 during standby operation.

FIG. 3 shows expansion valve flow control valve 58 and standby expansion valve flow control valve 60 in the high-pressure working fluid supply path 6 upstream of the expansion valve 4 and the standby expansion valve 56, respectively. The flow control valves 58 and 60 direct the flow of cooled high-pressure working fluid through the expansion valve 4 during normal operation and through the standby expansion valve during standby operation. The flow control valves 58 and 60 may be sequentially operated shut-off valves as shown in FIG. 3 or other means for directing flow between the expansion valve 4 and the standby expansion valve 56, such as a single two-way valve.

The flow valves 58 and 60 are expendable if the expansion valve 4 and standby expansion valve 56 are thermostatic expansion valves with different selected superheat valves such that the standby expansion valve 56 has a lower superheat setting than the expansion valve 4. The flow valves 58 and 60 are also expendable if the expansion valve 4 and the standby expansion valve 56 are proportional valves controlled electronically to serve as expansion valves.

Supplemental condenser 21 can be water or air cooled to balance the thermal energy, and may be coupled indirectly to compressor 14 via compressor output path 20 via compressor flow control valve 52. Supplemental condenser 21 may be coupled to the heat exchanger 22 via condenser output path 19. The output of the exchanger 22 may be regulated by backpressure valve 31 located between exchanger 22 and turbine 34 generally located in series along expendable turbine vapor output path 32. As depicted in FIG. 1, the expendable tank 24 discharges expendable into an expendable tank output path 26. An expendable feed pump 28 receives the expendable from the expendable tank output path 26 and discharges it into an expendable feed pump output path 30. The heat exchanger 22 then receives the expendable from the expendable feed pump output path 30.

Figure 4:
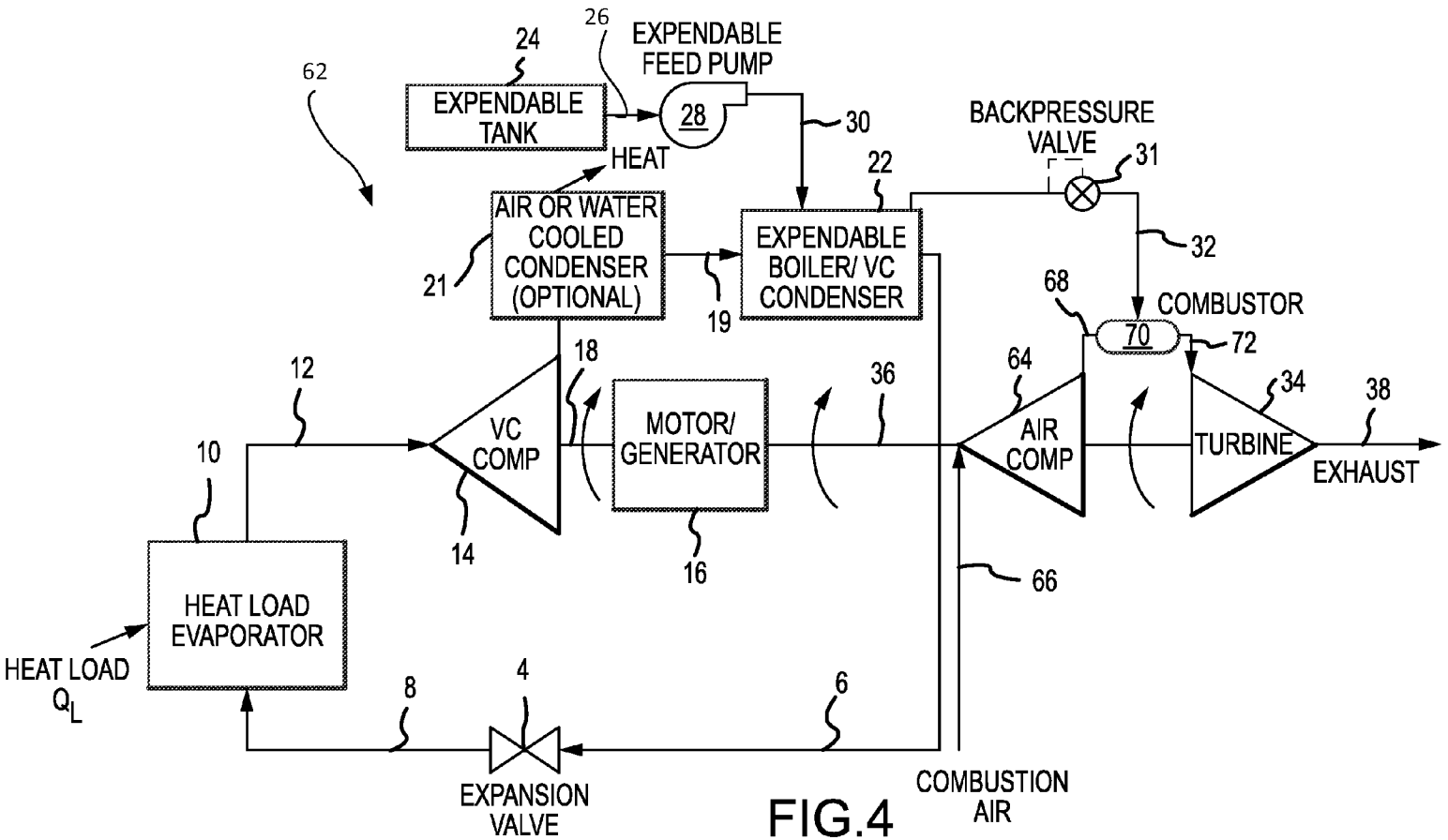
FIG. 4 is a schematic of a combusted expendable turbine driven vapor compression cycle cooling system in accordance with various embodiments.

FIG. 4 is a schematic of a combusted expendable turbine driven vapor compression cycle cooling system 62 according to various embodiments. Cooling system 62 comprises features that enable cooling system 62 to accurately manage a reduced standby load and condition the main load during "OFF" periods. FIG. 4 is similar in basic operation to the cooling system 2 described in connection with FIG. 2. However, cooling system 62 further comprises an air compressor 64 driven by the turbine drive shaft 36 that receives air from an air supply path 66, pressurizes it and discharges it into a compressed air path 68. By way of example only, it shows an arrangement wherein the heat exchanger 22 itself may store a quantity of expendable, as hereinbefore described, thus reducing the desirability of the expendable tank 24 and expendable feed pump 28. Of course, this embodiment may alternately comprise external storage of expendable with the expendable tank 24 and the expendable feed pump 28 if desired.

A combustor 70 receives the compressed air from the compressed air path 68 and pressurized expendable vapor from the expendable turbine vapor output path 32, combusts the expendable vapor with the compressed air and discharges high-pressure combustion gas into a combustor discharge path 72. The turbine 34 receives the high-pressure combustion gas from the combustor discharge path 72 and drives the air compressor 64 and the compressor 14 through the turbine drive shaft 36. The turbine 34 expands the pressurized combustion gas, thereby increasing its velocity and lowering its pressure, and discharges the high velocity low-pressure combustion gas into a turbine output path 38.

Figure 5:
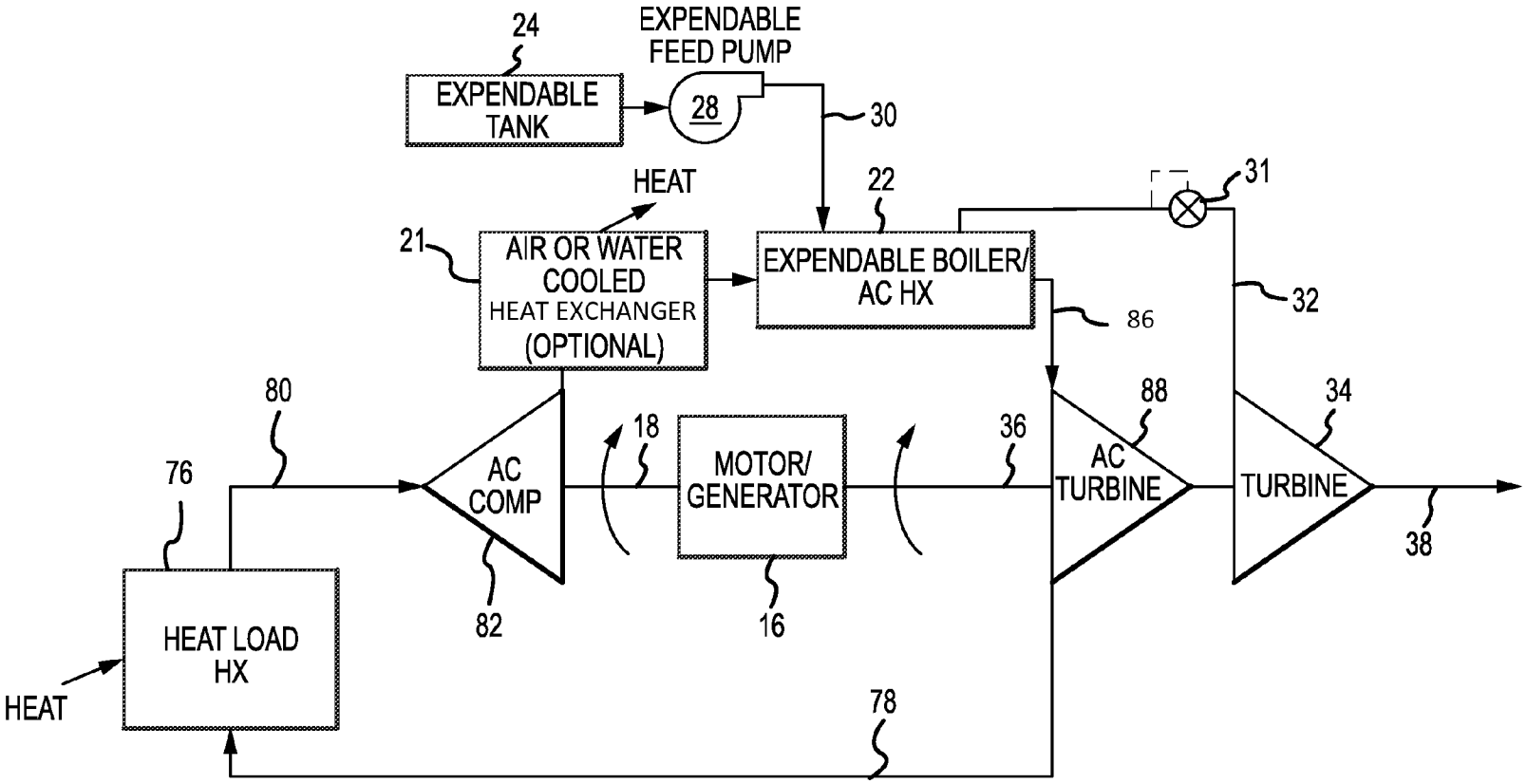
FIG. 5 is a schematic of an expendable turbine driven air compression cycle cooling system comprising an air cycle system in accordance with various embodiments.

According to various embodiments, it may be desirable to use a cooling system with an air compression cycle rather than a vapor compression cycle. FIG. 5 is a schematic of an expendable turbine driven air compression cycle cooling system 74 according to a various embodiments. Of course, this embodiment may alternately comprise external storage of expendable with the expendable tank 24 and the expendable feed pump 28 if desired. A low-pressure air or cool side heat exchanger 76 receives low-pressure air from a low-pressure air supply path 78 and transfers heat $Q_L$ from a heat load to the low-pressure air. The heat exchanger 76 then discharges the heated low-pressure air into a low-pressure heat exchanger output path 80.

An air compressor 82, driven by the motor/generator 16 through the compressor drive shaft 18 as hereinbefore described in connection with the other embodiments, compresses the heated low-pressure air to a high-pressure and discharges the heated high-pressure air into an air compressor output path 84. The high temperature or warm side heat exchanger 22 receives the heated high-pressure air from the air compressor output path 84 and cools it with the liquid expendable fluid. The expendable absorbs heat from the heated high-pressure air in the heat exchanger 22, thereby cooling the high-pressure air. The heat exchanger 22 then discharges the cooled high-pressure air into a high temperature heat exchanger output path 86. At the same time, the heated high-pressure air transfers heat to the expendable within the heat exchanger 22, thereby changing its state from a liquid to a pressurized gas. The heat exchanger 22 therefore serves as a boiler for the expendable. The latent heat or enthalpy of vaporization for the expendable allows the exchanger 22 to provide a significant heat transfer with minimal size and weight. The heat exchanger 22 then discharges the pressurized expendable vapor into the expendable turbine vapor output path 32.

The turbine 34 receives the pressurized expendable vapor from the expendable turbine vapor output path 32 and drives the compressor 82, along with the motor/generator 16, through the turbine drive shaft 36. The turbine 34 expands the pressurized expendable vapor, thereby increasing its velocity and lowering its pressure, and discharges the high velocity low-pressure expendable vapor into a turbine output path 38. At the same time, the turbine 88 receives the cooled high-pressure air from the heat exchanger output path 86 and expands the cooled high-pressure air, thereby lowering its pressure and cooling it still further. The power from the turbine 88 assists the turbine 34 and motor/generator 16 in driving the compressor 82. The air turbine then discharges the cold low-pressure air into the low-pressure air supply path 78, thereby completing the cycle.

Vaporizing the expendable in the heat exchanger 22 maximizes the degree of heat sinking that it can provide whilst driving the turbine 34 with the vaporized expendable assists driving the compressor 82 to minimize the electrical or mechanical shaft power required by the motor/generator 16. Thus, the cooling system 74 according to this possible embodiment of the invention provides greater cooling capacity with less input power than heretofore available systems.

The expendable heat sink systems disclosed herein may reduce the size and weight of the heat sink heat exchanger used to reject heat for a relatively short time. The systems and apparatus described herein may be appropriate for use as a thermal management system of a vehicle mounted high energy laser. The large ambient air heat exchanger may be replaced with one of the embodiments described herein to reduce total size and weight of the system. Additionally, the exhaust plume may comprise a small cross-section reducing potential interference with the laser beam as compared with conventional large ambient air heat exchanger. For an aircraft system, the elimination of the large cross-sectional area heat exchanger used part-time can result in a significant drag reduction during flight.

Addition of a backpressure control valve on the vapor exit of the expendable boiler allows for control of valve opening to regulate boiler pressure and then the resultant boiling temperature to maintain a close temperature tolerance even as the heat load varies significantly. The backpressure control valve on the vapor exit of the expendable boiler also provides the ability to use a more volatile (lower boiling temperature) expendable fluid than is required due to availability or better overall thermal characteristics or desire for a readily available combustible fluid.

A consistent boiling temperature may be maintained during operation of the system through the use of a backpressure control valve on the vapor exit of the expendable boiler. The consistent boiling temperature may be maintained during periods of varying exit pressure due to ambient pressure changes (change of altitude) or turbine back pressure. Also, the backpressure control valve deposed on the vapor exit of the expendable boiler affords the system the ability to adjust turbine inlet conditions of pressure and resultant temperature. In this way, an optimization between turbine power generation and cooling cycle power input requirements can be achieved. An air or water cooled condenser to the main cooling circuit (not just the standby) to provide additional and variable cooling capacity to that provided by the expendable boiler may reduce expendable consumption when conditions permit at least some air or water cooling.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Different cross-hatching is used throughout the figures to denote different parts but not necessarily to denote the same or different materials.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A cooling system comprising a compression cycle for cooling a working fluid, comprising:

a cool side heat exchanger for transferring thermal energy from a heat load to the working fluid that heats the working fluid to form a heated working fluid;

a compressor driven by a motor that receives the heated working fluid and compresses the heated working fluid to a high-pressure to form a heated high-pressure working fluid;

a supplemental condenser that receives the heated high-pressure working fluid from the compressor and cools the heated high-pressure working fluid with a first cooling fluid to produce a first cooled high-pressure working fluid;

a warm side heat exchanger that receives the first cooled high-pressure working fluid from the supplemental condenser and cools the first cooled high-pressure working fluid with an expendable fluid that receives heat from the first cooled high-pressure working fluid and vaporizes the expendable fluid to produce a pressurized expendable fluid and second cooled high-pressure working fluid;

an expansion valve that expands the second cooled high-pressure working fluid into the heated working fluid for input into the compressor;

a turbine powered by the pressurized expendable fluid that assists the motor to drive the compressor, wherein the expendable fluid exiting the turbine is exhausted to an ambient environment;

a backpressure control valve configured to be coupled in series between the turbine and the warm side heat exchanger;

an expendable storage tank for storing the expendable fluid; and an expendable feed pump for transferring the expendable fluid from the expendable storage tank to the warm side heat exchanger.

2. The cooling system of claim 1, wherein the expendable fluid is selected from a group of hydrocarbons comprising propane and butane.

3. The cooling system of claim 1, wherein control of the backpressure control valve regulates at least one of warm side heat exchanger pressure and a resultant boiling temperature.

4. The cooling system of claim 1, wherein the backpressure control valve is configured to increase a selection of thermal characteristics of acceptable expendable fluids.

5. The cooling system of claim 1, wherein operation of the backpressure control valve affords maintenance of a consistent boiling temperature during operation of the cooling system with varying exit pressure due to at least one of ambient pressure changes or a turbine back pressure.

6. The cooling system of claim 1, wherein operation of the backpressure control valve yields an ability to adjust turbine inlet conditions of pressure and resultant temperature to optimize between a turbine power generation and a cooling cycle power input requirement.

7. The cooling system of claim 1, wherein the supplemental condenser is at least one of water cooled or air cooled.

8. The cooling system of claim 7, wherein the supplemental condenser is coupled to the compressor via a compressor output path.

9. The cooling system of claim 8, wherein the supplemental condenser is configured to reduce expendable fluid consumption when conditions permit air or water cooling.

10. The cooling system of claim 8, wherein the supplemental condenser is configured to provide additional and variable cooling capacity to that provided by the warm side heat exchanger.

* * * * *